US005941042A

United States Patent [19]

Dueck

[11] Patent Number: 5,941,042

[45] Date of Patent: Aug. 24, 1999

[54] GARDEN BLOCK

[75] Inventor: Vernon J. Dueck, Coquitlam, Canada

[73] Assignee: Pacific Precast Products Ltd., British Columbia, Canada

[21] Appl. No.: 08/895,426

[22] Filed: Jul. 16, 1997

[51] Int. Cl.[6] ..... E04C 1/00

[52] U.S. Cl. ..... 52/604; 52/603; 52/592.6; 52/589.1; 405/286

[58] Field of Search ..... 52/604, 605, 606, 52/608, 592.6, 592.4; 405/284, 286

[56] References Cited

U.S. PATENT DOCUMENTS

| | | | |
|---|---|---|---|
| 4,107,894 | 8/1978 | Mullins | 52/592.6 |
| 4,229,123 | 10/1980 | Heinzmann | 52/608 X |
| 4,914,876 | 4/1990 | Forsberg | 52/562 X |
| 5,161,918 | 11/1992 | Hodel | 52/606 X |
| 5,257,880 | 11/1993 | Janopaul, Jr. | 52/606 |
| 5,337,527 | 8/1994 | Wagenaar | 52/604 X |
| 5,421,135 | 6/1995 | Stevens et al. | 52/604 |
| 5,490,363 | 2/1996 | Woolford | 52/604 |
| 5,505,034 | 4/1996 | Dueck | 52/604 |
| 5,711,130 | 1/1998 | Shatley | 52/606 X |

*Primary Examiner*—Carl D. Friedman
*Assistant Examiner*—Winnie S. Vip
*Attorney, Agent, or Firm*—Smith Patent Office

[57] ABSTRACT

A block useful for constructing retaining walls for gardens, has two bottom lugs or knobs, bracketing an internal cavity. The cavity may be filled with soil. In forming a wall, the upper row of blocks is rearwardly onset from the lower row of blocks, whereby the lugs of the blocks of the upper row abutting the back surfaces of the blocks of the lower row.

11 Claims, 2 Drawing Sheets

GARDEN BLOCK

FIELD OF INVENTION

This invention relates to blocks and retaining walls suitable for gardens and other small non-construction sites.

BACKGROUND OF INVENTION

Small retaining walls for gardens and other sites of similar dimensions and requirements, are ideally constructed simply and with minimum equipment.

SUMMARY OF INVENTION

According to this invention, there is provided a block for forming a retaining wall comprising: (a) a body with front, rear, top, bottom and side surfaces and a central cavity with internal walls; (b) projecting means integrally formed on said bottom surface proximate said front surface and being laterally offset from said cavity and rearwardly offset from the front of the cavity and having a rounded front surface.

According to another aspect of this invention, there is provided a retaining wall comprising: (a) a lower row of blocks arranged side by side, each block having a body with a cavity and a rear surface; (b) an upper row of blocks arranged side by side, each block having a body with a cavity and projecting means integrally formed on said bottom surface, whereby said projecting means abut the rear surfaces of proximate block of the lower row.

BRIEF DESCRIPTION OF DRAWINGS

Advantages of the present invention will become apparent from the following detailed description taken in conjunction with preferred embodiments shown in the accompanying drawings, in which.

DETAILED DESCRIPTION OF THE PREFERRED EMBODIMENTS

Figure 1:
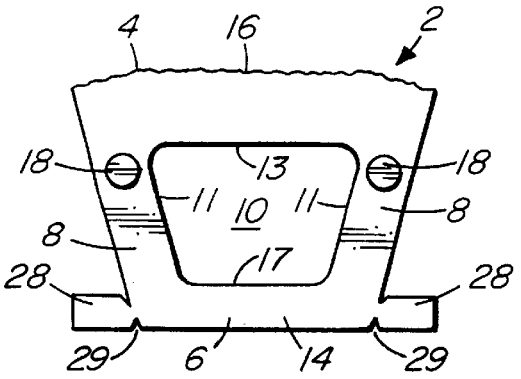
FIG. 1 is a plan view of a block according to the invention.
Figure 2:
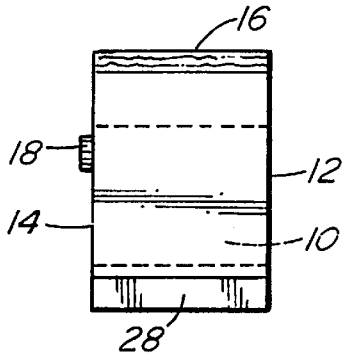
FIG. 2 is a side view of the block of FIG. 1.
Figure 5:
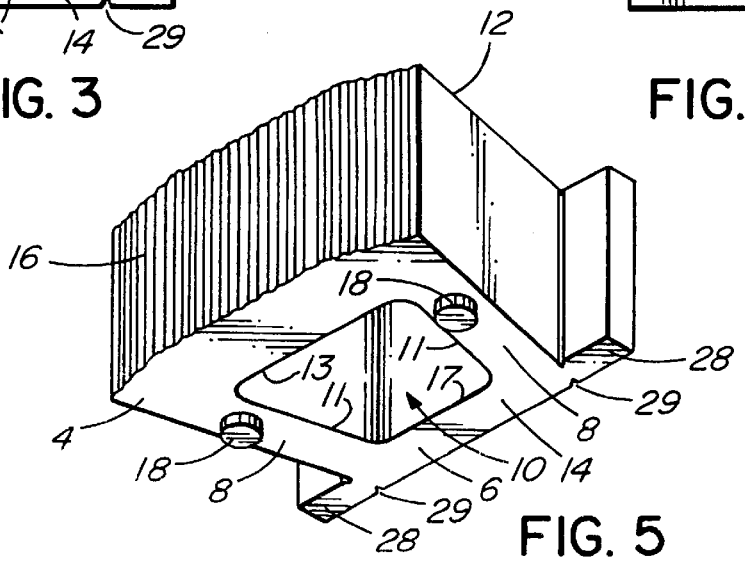
FIG. 5 is a perspective view of the block of FIGS. 1 and 2.

FIGS. 1, 2 and 5 show a first embodiment of a block 2 for forming a retaining wall. Block 2 includes spaced front and rear wall portions 4 and 6 respectively. A pair of side walls 8 extend between and join the front and rear wall portions to define a central open cavity 10 through the block having internal side walls 11, internal front wall 13 and internal rear wall 17. The block has upper surface 12 and a lower surface 14. Block 2 is preferably formed from concrete and the face of front wall portion 4 is formed with a roughened pattern 16. Block 2 has a generally trapezoidal shape in plan view with the wall portion 4 wider than the rear wall portion 6.

Rear wall portion 6 of block 2 includes a frangible extension 28 that extends beyond sidewalls 8. Extensions 28 can be broken off along pre-formed fault lines 29 (e.g. by a hammer) so that block 2 is reduced to essentially an arcuate segment. Such a block 2 can then be rotated to a desired angle to form a curved retaining wall, as shown in FIG. 7 described below.

Block 2 is provided with projecting means in the form of a pair of spaced, cylindrical extensions or knobs 18. Knobs 18 are integrally formed on the lower surface 14 of side walls 8 behind the front edge of cavity 18. Although knob 18 is shown to be cylindrical, it need only have a front curved surface to be able to rotate and accommodate a desired curved configuration of retaining wall, or could have a flat front surface if non-curved configurations are sufficient. Although knob 18 is shown to be positioned proximate the front edge of cavity 18, knob 18 can be positioned farther rearwardly. The extent that knob 18 is positioned behind the front edge of cavity 18 determines the rearward offset of the wall constructed, as described below.

Figure 6:
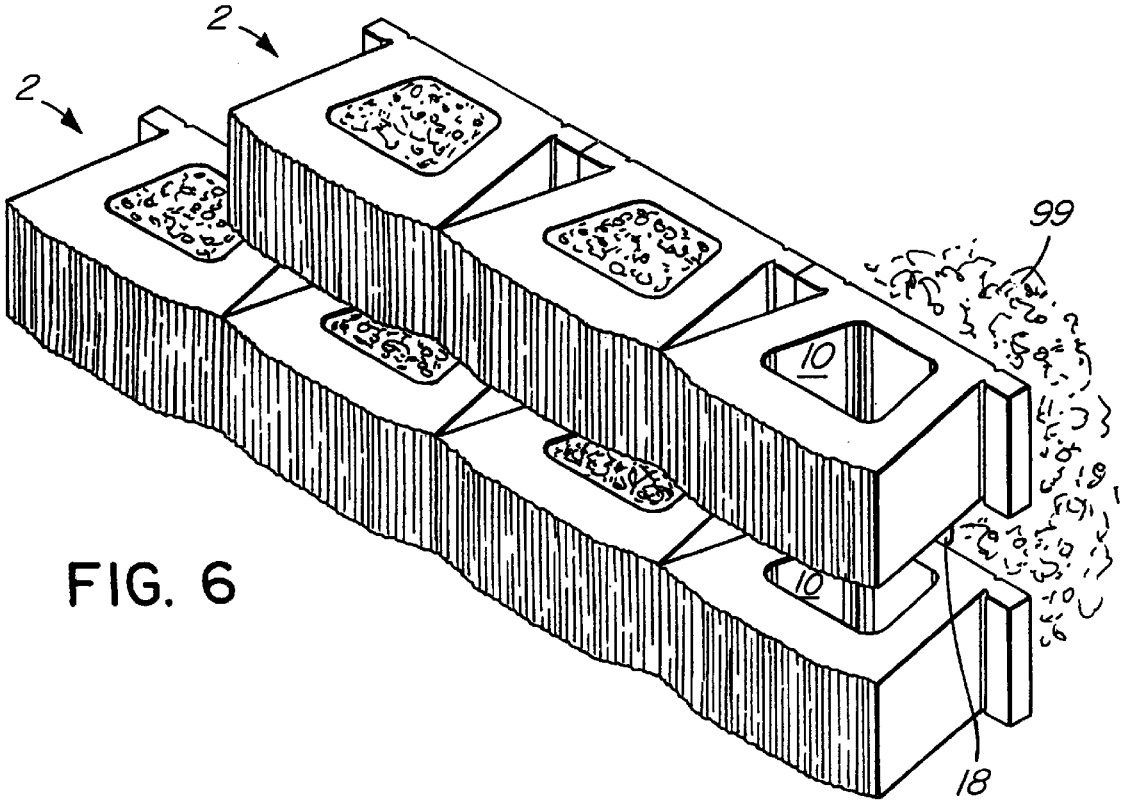
FIG. 6 is a perspective view of a wall formed of the block of FIG. 5.
Figure 7:
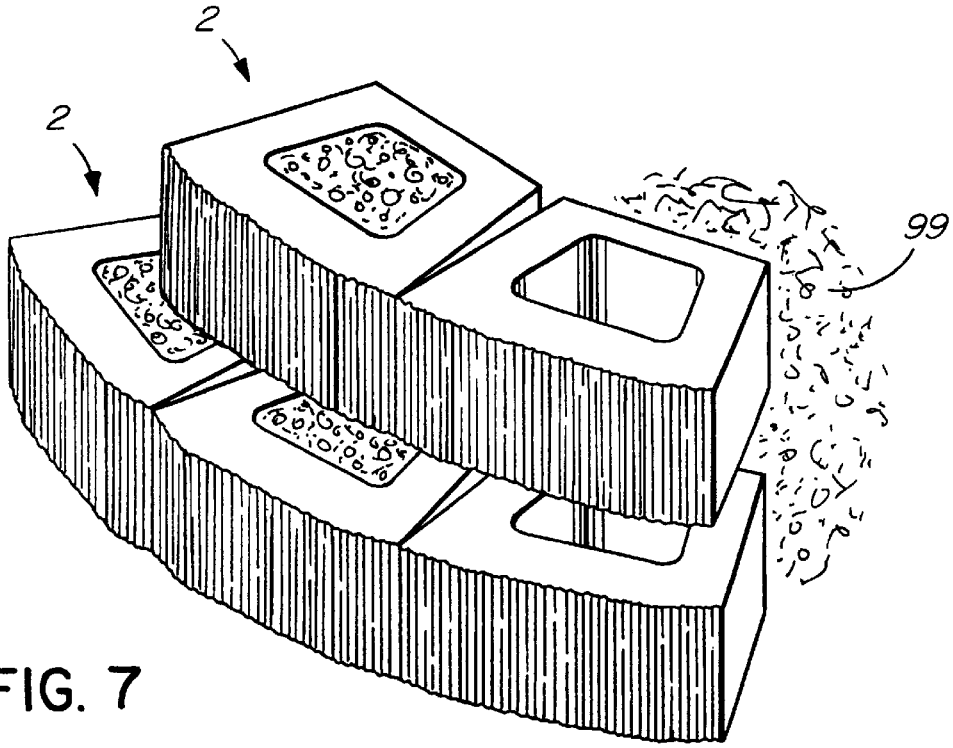
FIG. 7 is a perspective view of a variation of the wall of FIG. 6.

FIGS. 6 and 7 show retaining walls constructed with the foregoing described first embodiment of blocks 2. A first row of blocks 2 is laid on the ground or in a shallow trench dug in the ground. Blocks 2 are backfilled with soil 99 and cavities 10 are filled with soil or loose angular gravel and dirt, to anchor the row of blocks 2, to permit drainage of water therethrough, and to permit plants and flowers to be planted therein. After completion of the first row and backfilling as described, a second row of blocks 2 is laid. The blocks 2 of the second row are laterally offset from the blocks 2 of the first row. In particular, a block 2 of the second row is positioned in approximately half bond relationship to two underjacent blocks 2 of the first row (i.e. the upper block 2 is centered approximately at the plane of contact between the two underjacent blocks 2. The two knobs 18 of a block 2 of the second row abut the respective rear wall portions 6 of the two adjacent blocks 2 of the first row. One such abutment of knob 18 is shown in FIG. 6. Thus formed, the second row of blocks 2 are rearwardly offset from the first row of blocks 2. Then the blocks 2 of the second row are backfilled and filled, and the above process is continued for perhaps several more rows for a common garden setting.

FIG. 7 shows an arcuate wall of blocks 2 where the frangible extensions 28 have been removed.

Figure 3:
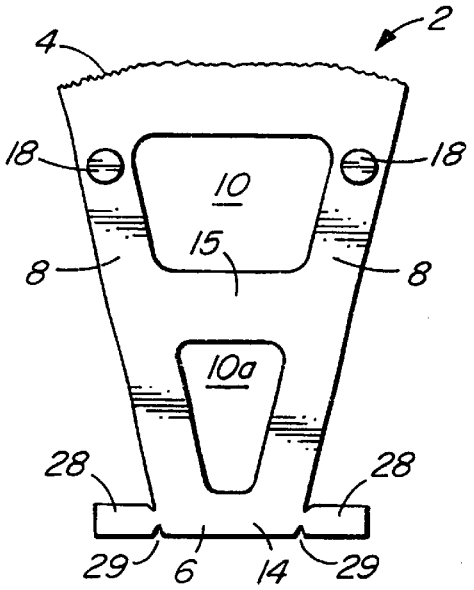
FIG. 3 is a plan view of a second embodiment of the block of the invention.
Figure 4:
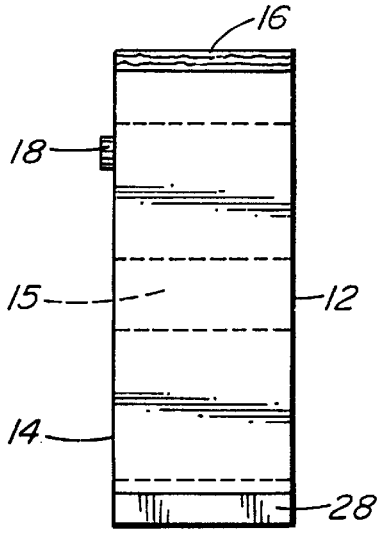
FIG. 4 is a side view of the block of FIG. 3.

FIGS. 3 and 4 show a second embodiment of block 2 having generally larger dimensions than those of the first embodiment. A reinforcing web 15 is provided between side walls 8 at substantially mid-length therealong to form front and rear internal cavities 10 and 10*a*. The blocks of FIGS. 3 and 4 are used for larger retaining walls because their additional size and mass allows them to support a greater bulk of soil. The method of creating retaining walls described above for the first embodiment of block 2, is applied to the second embodiment of block 2. One variation (not shown) is that knobs 18 may abut the rear wall portion 6 or be inserted into rear internal cavity 10*a* and abut a front surface thereof, thus allowing a variation in the rearwardly offset of superjacent rows of blocks 2. In contrast, a wall employing the first embodiment of block 2 will have a uniform rearwardly offset between superjacent rows.

Typical dimensions of the fist embodiment of block 2 are 4" high by 12" wide by 8" deep with knobs 0.5" high and 2.5" in diameter if the knob is cylindrical. It will be appreciated that the dimensions given are merely for purposes of illustration and are not limiting in any way. The specific dimensions given may be varied in practising this invention, depending on the specific application.

While the principles of the invention have now been made clear in the illustrated embodiments, there will be immediately obvious to those skilled in the art, many modifications of structure, arrangements, proportions, the elements, materials and components used in the practice of the invention, and otherwise, which are particularly adapted for specific environments and operational requirements without departing from those principles. The claims are therefore intended to cover and embrace such modifications within the limits only of the true spirit and scope of the invention.

What is claimed is:

1. A retaining wall comprising:

(a) a lower row of blocks arranged side by side, each block having a body with a cavity and a rear portion;

(b) an upper row of blocks arranged side by side, each block having a body with a front, rear and bottom portion, two side portions and a central cavity with a front internal wall and projecting means integrally formed on said bottom portion between a plane containing said front internal wall and a plane containing a rear internal wall of the central cavity, said projecting means being laterally, outwardly and rearwardly offset from said cavity front internal wall and having a rounded front surface, wherein said projecting means abuts said rear portion of a proximate block in the lower row and said front, rear, top, bottom and side portions being rearwardly offset in relation to the proximate block in the lower row.

2. A retaining wall as claimed in claim 1, wherein the cavities are filled with granular fill.

3. A retaining wall as claimed in claim 1, wherein all the blocks in said upper row are identical.

4. A retaining wall as claimed in claim 3, wherein the cavities are filled with granular fill.

5. A retaining wall as claimed in claim 1, wherein the rows of blocks are arranged in a straight configuration.

6. A retaining wall as claimed in claim 5, wherein the cavities are filled with granular fill.

7. A retaining wall as claimed in claim 1, wherein said rear portion comprises a frangible extension that extends parallel to said rear portion.

8. A retaining wall as claimed in claim 1, wherein one block in said upper row has the frangible portion of the one block removed and the one block is disposed relative to its adjacent block in that said upper row so that the corresponding portion of the wall defined by said two blocks, is partially arcuate.

9. A retaining wall as claimed in claim 1, wherein the cavities are filled with granular fill.

10. A retaining wall comprising:

(a) a lower row of blocks arranged side by side, each block having a body with a cavity and a rear portion;

(b) an upper row of blocks arranged side by side, wherein each block in said upper row comprising a body with a front, rear and bottom portion, two side portions, a front cavity with a front internal wall and a rear cavity with a rear internal wall and projecting means integrally formed on said bottom portion between a plane containing said front internal wall of said front cavity and a plane containing said rear internal wall of the rear cavity, said projecting means being laterally, outwardly and rearwardly offset from said cavity front internal wall and having a rounded front surface, wherein said projecting means abuts said rear portion of a proximate block in the lower row and said front, rear, top, bottom and side portions being rearwardly offset in relation to the proximate block in the lower row.

11. A retaining wall as claimed in claim 10, wherein the cavities are filled with granular fill.

* * * * *